US009593913B1

(12) United States Patent
Wright et al.

(10) Patent No.: US 9,593,913 B1
(45) Date of Patent: Mar. 14, 2017

(54) DIGITAL POSITIONING SYSTEM AND ASSOCIATED METHOD FOR OPTICALLY AND AUTOMATICALLY STABILIZING AND REALIGNING A PORTABLE WEAPON THROUGH AND AFTER A FIRING SHOCK

(71) Applicants: Michael T. Wright, Hopatcong, NJ (US); Peter Tewksbury, Leesburg, VA (US); James Marraccini, Hamilton, VA (US)

(72) Inventors: Michael T. Wright, Hopatcong, NJ (US); Peter Tewksbury, Leesburg, VA (US); James Marraccini, Hamilton, VA (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 14/712,109

(22) Filed: May 14, 2015

(51) Int. Cl.
*F41G 5/00* (2006.01)

(52) U.S. Cl.
CPC ..... *F41G 5/00* (2013.01)

(58) Field of Classification Search
CPC ..... F41G 3/12; F41G 5/00; F41G 5/02; F41G 5/04; F41G 5/06; F41G 5/08; F41G 5/12; F41G 5/14; F41G 5/16; F41G 5/18; F41G 5/20; F41G 5/22; F41G 5/24; F41G 5/26; F41A 27/00; F41A 27/30
USPC ..... 89/41.01–41.22, 200–206; 235/400, 404
See application file for complete search history.

(56) References Cited

U.S. PATENT DOCUMENTS

| | | | | |
|---|---|---|---|---|
| 5,280,744 | A * | 1/1994 | DeCarlo | F41G 3/04 235/407 |
| 5,413,028 | A * | 5/1995 | Ng | F41G 3/323 89/37.08 |
| 6,497,171 | B2 * | 12/2002 | Gerber | F41A 27/28 89/41.02 |
| 8,322,269 | B2 * | 12/2012 | Sullivan | F41A 27/14 89/41.11 |
| 8,490,539 | B2 * | 7/2013 | Otto | F41A 27/28 89/41.02 |
| 8,661,962 | B1 * | 3/2014 | Hart | F41A 25/12 235/404 |
| 9,074,847 | B1 * | 7/2015 | Sullivan | F41G 5/06 |
| 2003/0231299 | A1 * | 12/2003 | Schneider | F41G 5/26 356/139.06 |

(Continued)

*Primary Examiner* — Bret Hayes
(74) *Attorney, Agent, or Firm* — John P. DiScala

(57) ABSTRACT

A digital positioning system that interfaces with a portable weapon to automatically realign the weapon through and after a firing shock that saturates electronic components of the portable weapon. The digital positioning system includes a digital fire control device that receives target destination data. The digital fire control device transmits the target destination data to an automatic calibration and pointing device, which, in turn, generates a reference orientation from the target destination data. In response to the firing shock, the automatic calibration and pointing device acquires a current orientation of the portable weapon, independently of the saturated electronic components, and compares the current orientation to the stored reference orientation for causing a mechanical alignment and orientation mechanism to reposition the portable weapon.

10 Claims, 8 Drawing Sheets

(56) References Cited

U.S. PATENT DOCUMENTS

| | | | | |
|---|---|---|---|---|
| 2005/0263000 | A1* | 12/2005 | Hill | F41A 27/30<br>89/136 |
| 2010/0269681 | A1* | 10/2010 | Shipman | F41F 1/06<br>89/42.01 |
| 2014/0118723 | A1* | 5/2014 | Winker | G01B 11/26<br>356/72 |

* cited by examiner

DIGITAL POSITIONING SYSTEM AND ASSOCIATED METHOD FOR OPTICALLY AND AUTOMATICALLY STABILIZING AND REALIGNING A PORTABLE WEAPON THROUGH AND AFTER A FIRING SHOCK

GOVERNMENTAL INTEREST

The invention described herein may be manufactured and used by, or for the Government of the United States for governmental purposes without the payment of any royalties thereon.

FIELD OF THE INVENTION

The present invention relates in general to the field of weapons. Specifically, the present invention relates to a digital positioning system that interfaces with the portable weapon, for automatically stabilizing and realigning the portable weapon through and after a firing shock.

BACKGROUND OF THE INVENTION

The gunner's role in weapons such as mortars, is to receive the fire command, lay in the gun, and then fire the round. Laying in the mortar involves pointing it, vertically and horizontally in such a way that the round will impact in a given target area. However, gunners may be required to physically point, calibrate, and re-orient the mortar using an optical sight unit that is mounted onto the mortar tube.

Upon firing, the generated firing shock level might be sufficient to saturate the digital MEMS type electronic components, such as the inexpensive magnetic sensors and inertial sensors (e.g., inertial measurement units (IMUs)) used in the pointing device of the portable mortars. Saturation of the electrical components, such as the magnetic sensors and inertial sensors, refers to the condition of the sensors being subjected to conditions outside of the sensing limits of the sensor. For example, a saturated sensor may display maximum or minimum readings, a signal indicating that the condition is outside the sensing range or a clipping of the output. As a result, once the portable mortar is fired, the saturation of the electronic components causes the orientation system to become inaccurate, thus altering the realignment system, and debilitating the pointing device from being able to provide orientation information. Consequently, the portable mortar will then have to be manually reoriented.

Larger mortars, Howitzers, and other complex weapon systems that are provided with a digital fire control device, dispense with the need to use optical sights, and avoid the problem facing smaller, portable weapon systems. These larger weapon systems are digitally pointed by means of a computer (or a processor) that computes the pointing direction of the gun tubes, and provides accurate, real time orientation instructions to a pointing device on the weapon systems.

However, the cost of integrating or retrofitting the portable mortar systems with a digital fire control device used in the larger weapon systems, is prohibitively expensive.

Prior to the advent of the present invention, there has been no successful, practical, and cost effective solution to overcoming the problems associated with the saturation of the electronic components. Therefore, there still remains an unsatisfied need for a digital positioning system that interfaces with portable weapon systems, for automatically stabilizing and realigning the portable weapons, through and after the firing shock.

SUMMARY OF THE INVENTION

The present invention addresses the foregoing concerns and presents a new digital positioning system that interfaces with a portable weapon system (e.g., a portable mortar), for automatically stabilizing and realigning the portable weapon, through and after the firing shock.

As a result, it is now possible to replace the conventional optical sight unit of the portable mortar with a digital positioning system that is comprised of a digital fire control device and an automatic calibration and pointing device. The automatic calibration and pointing device provides an alternative optical tracking method for storing a reference orientation, and for determining the current orientation of the mortar tube. The digital fire control device provides the gunner with operational control via a visual interface. As a result, the digital positioning system allows the portable mortar to be realigned to its initial position, despite the saturation of the electronic components.

The automatic calibration and pointing device causes the mechanical alignment and orientation mechanism of the portable mortar to automatically and digitally align the mortar tube, shortly after firing. The automatic calibration and pointing device incorporates a processor that uses input data from a camera and inertial sensors, such as an inertial measurement unit (IMU) to instruct other components, such as a chronometer, a gyroscope, a magnetometer, of the current orientation of the mortar tube, as needed, to cause the realignment of the mortar tube to the target orientation.

As a result, in the event of saturation of the electronic components, such as the inertial sensors, following the firing shock, the portable mortar disregards the input data from these saturated components. Instead, the portable mortar relies on input data from the automatic calibration and pointing device.

To this end, the camera of the automatic calibration and pointing device stores a reference image associated with initial target orientation, and then uses this reference image to determine its current orientation. Based on the mismatch between the target orientation, as reflected in the stored reference image, and the current orientation, the automatic calibration and pointing device realigns the inertial sensors back to the target orientation. Consequently, although the inertial sensors may become saturated after firing, the automatic calibration and pointing device is capable of continuously tracking the orientation of the mortar tube, without losing the stored target pointing and orientation data.

BRIEF DESCRIPTION OF THE DRAWINGS

The accompanying drawings, which are incorporated in, and constitute part of this specification, illustrate embodiments of the invention and together with the description, serve to explain the principles of the invention. The embodiments illustrated herein are presently preferred, it being understood, however, that the present invention is not limited to the precise arrangements and instrumentalities shown, wherein:

FIG. 3 is comprised of FIGS. 3A and 3B, wherein

Similar numerals refer to similar elements in the drawings. It should be understood that the sizes of the different components in the figures are not necessarily in exact proportion or to scale, and are shown for visual clarity and for the purpose of explanation.

DETAILED DESCRIPTION OF PREFERRED EMBODIMENTS

Figure 1:
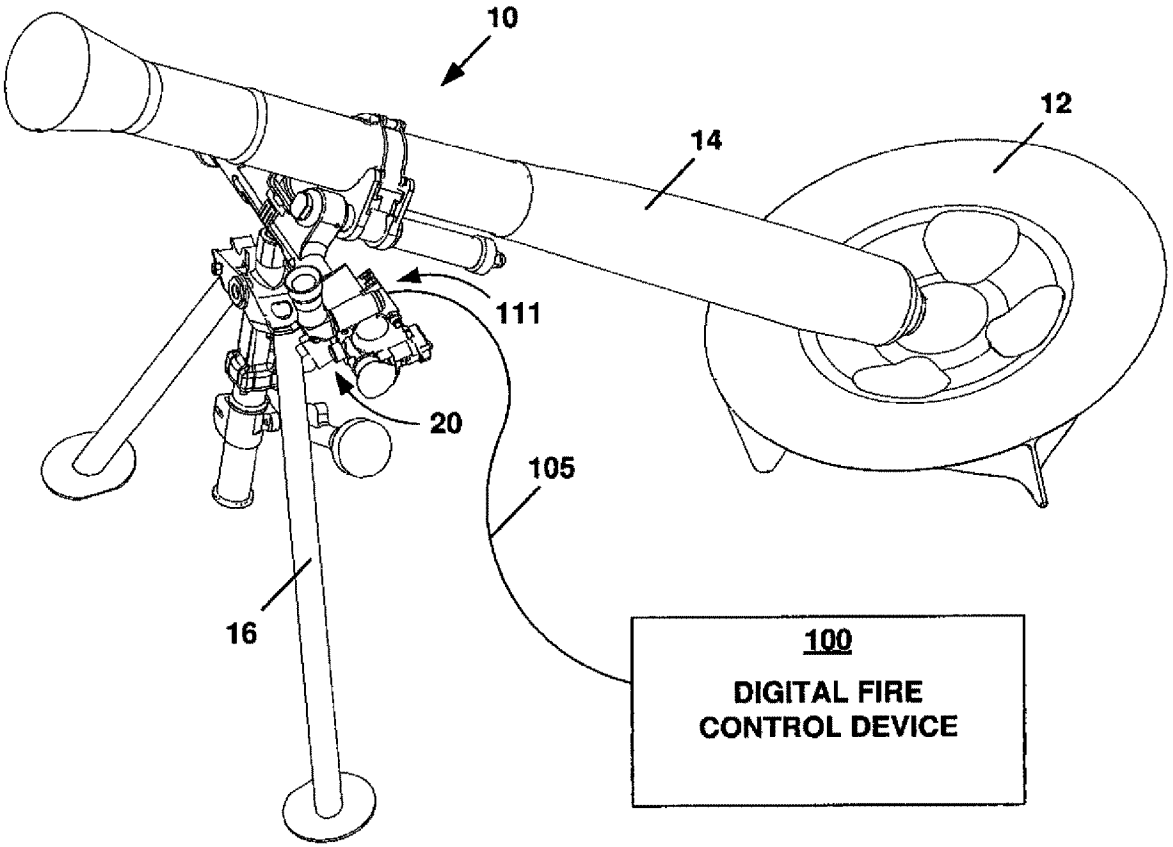
FIG. 1 is an isometric, perspective view of an exemplary portable weapon, such as a mortar, for use in conjunction with a digital positioning system comprised of a digital fire control device and an automatic calibration and pointing device, in order to automatically stabilize and realign the portable mortar, through and after the firing shock, according to a preferred embodiment of the present invention.
Figure 2:
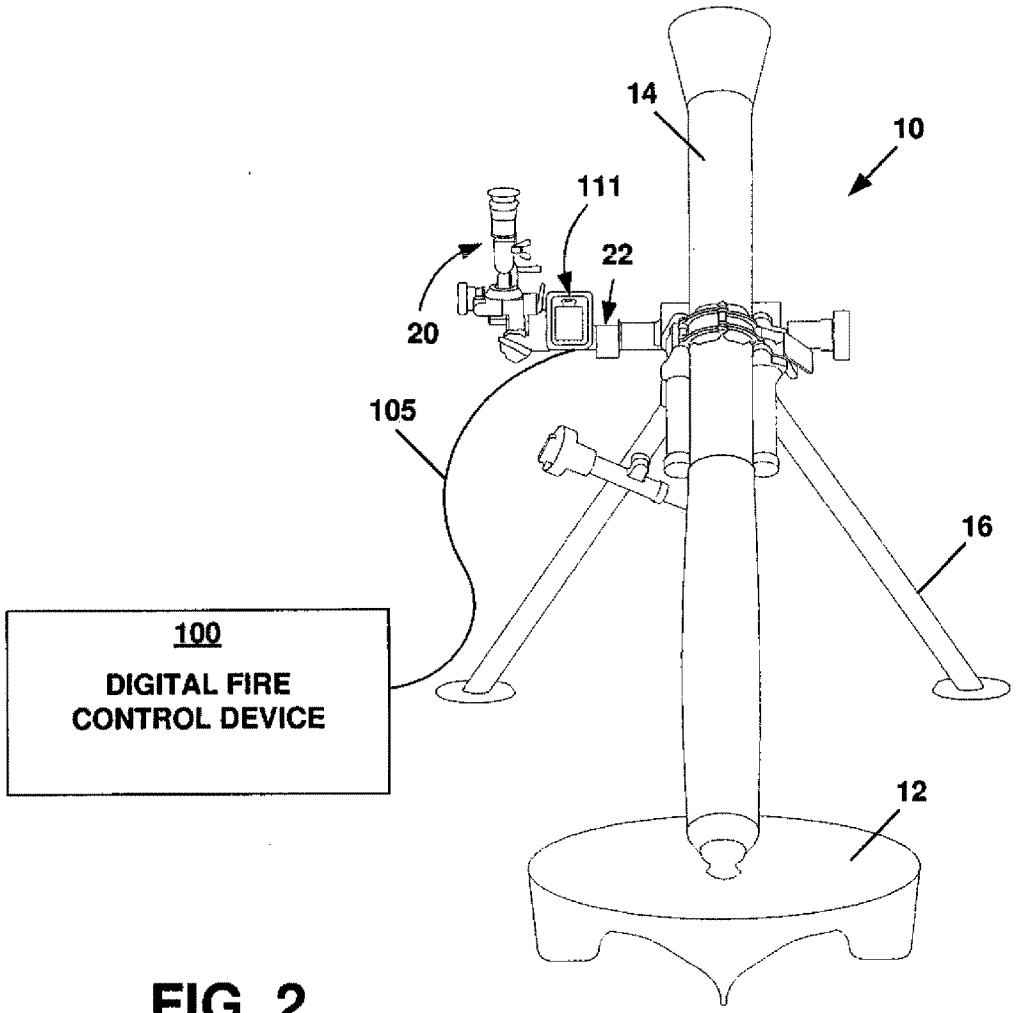
FIG. 2 is an isometric, rear elevational view of the portable mortar of FIG. 1.

With reference to FIGS. 1, 2, and 3, they illustrate an exemplary weapon system 10, such as a portable mortar, for use by a gunner (or soldier). While the present invention will be described herein in connection with a weapon system, it should be clear that the present invention is equally adaptable to commercial applications, to provide a continuous alignment to a target destination, on a real time basis, despite the saturation of the certain magnetic, electrical, electromagnetic, and inertial sensors. While the saturation has been described herein as resulting from a fire shock, it should be clear that the causes of the saturation are not intended to be limited to the fire shock.

The portable mortar 10 generally includes a baseplate 12 that supports a gun tube (or mortar tube 14). A bipod 16 provides additional support and stability to the gun tube 14. Optionally, a conventional optical sight unit 20 is mounted on a support 22 or mount 333 (FIG. 3), which, in turn, is affixed to the bipod 16.

Figure 3A:
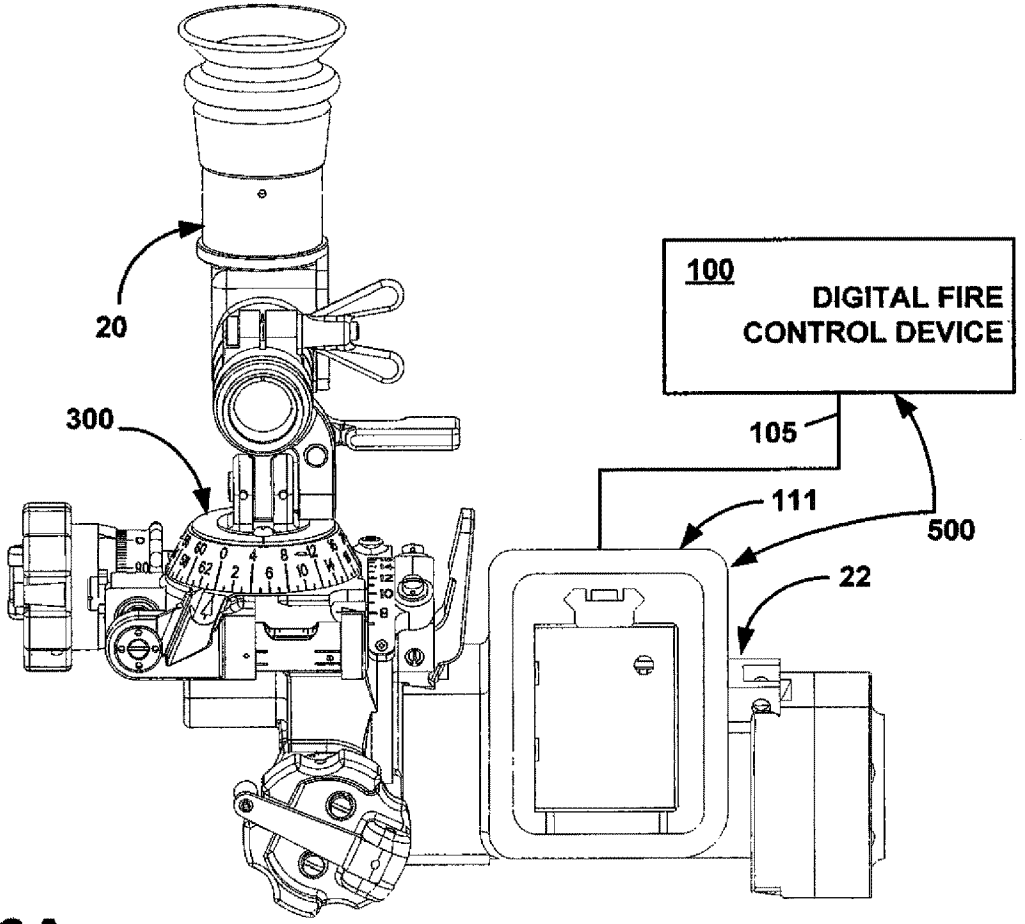
FIG. 3A is an enlarged view of the digital positioning system of FIGS. 1 and 2, illustrating a mount for housing the automatic calibration and pointing device, and which is secured to a tripod support.
Figure 3B:
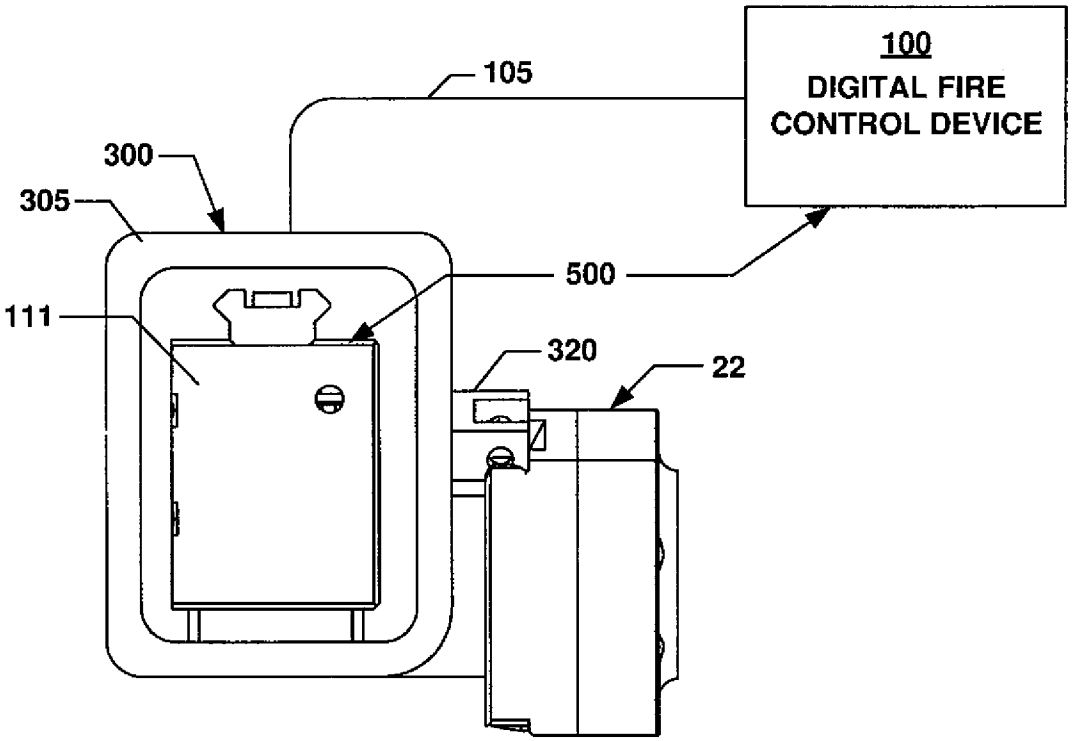
FIG. 3B is an enlarged view of the digital positioning system of FIG. 3A, without the optical sight unit.

More specifically, FIG. 3A illustrates the digital pointing device 100 mounted adjacent to the optical sight unit 20, in such a way as to avoid impeding the use of the optical sight unit 20. The digital pointing device 100 is mounted on the support 22 by means of a mount 333. FIG. 3B illustrates the embodiment that dispenses with the use of the optical sight unit 20.

An exemplary mount 333 is illustrated in FIG. 3B as including a generally cubically shaped, hollow receptacle 305 that is open at both ends. The receptacle 305 houses the digital pointing device 111. A dovetail connector 320 extends from one side of the receptacle 305, in order to secure the receptacle 305 to the bipod support 22.

Figure 5:
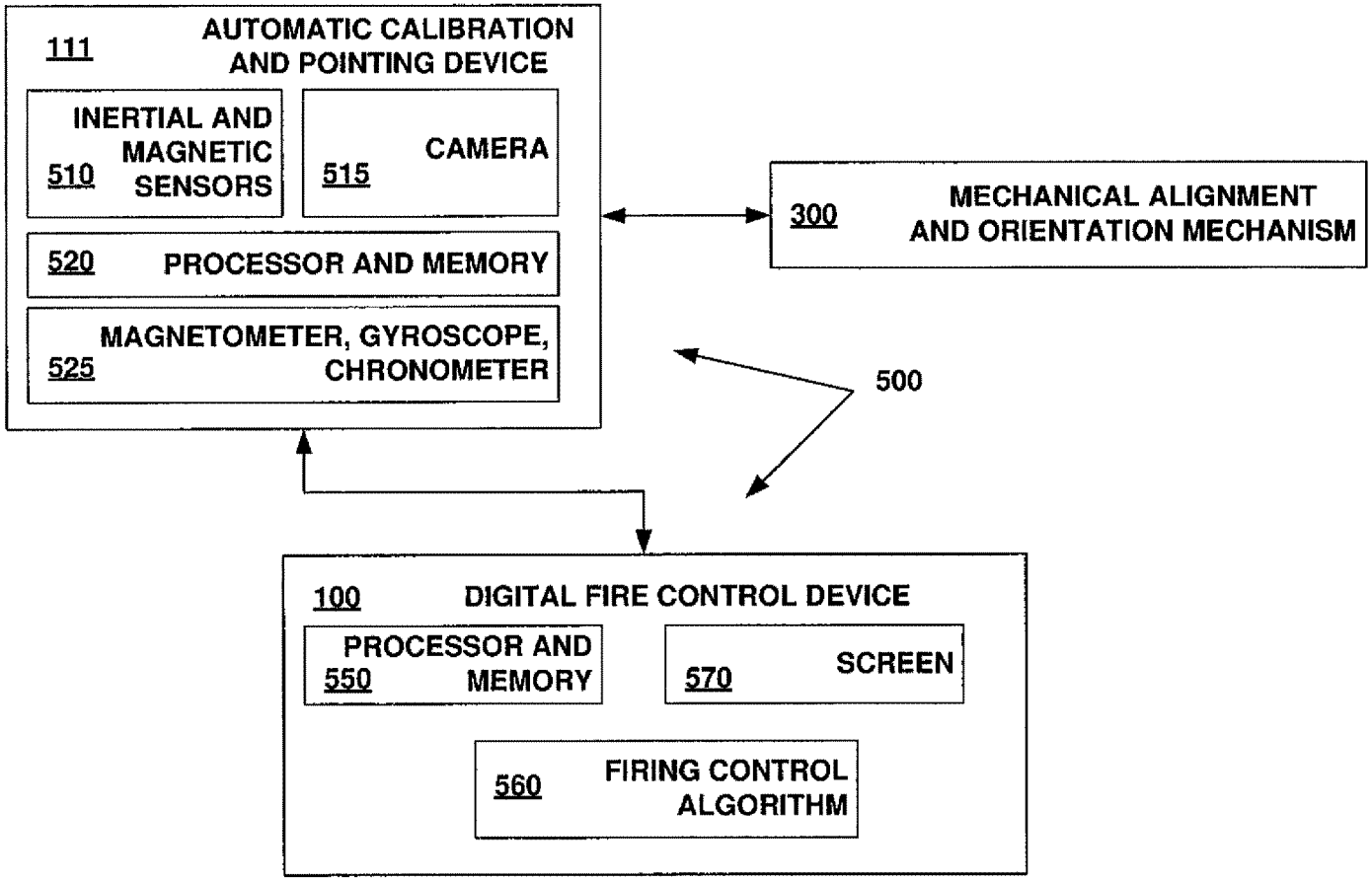
FIG. 5 is a high level block diagram showing the main components of the digital positioning system and the mechanical alignment and orientation mechanism.

A digital fire control device 100 is connected to an automatic calibration and pointing device 111 by means of a cable 105. Alternatively, the connection between the digital fire control device 100 and the automatic calibration and pointing device 111 can be done wirelessly, or networked for remote access. The combination of the automatic calibration and pointing device 111 and the digital fire control device 100 is collectively referred to as digital positioning system 500 (FIGS. 3 and 5).

The digital fire control device 100 provides the gunner with control over the operation of the portable mortar 10. The gunner's instructions are transmitted to the automatic calibration and pointing device 111 by means of the cable 105. In response to the firing shock, the automatic calibration and pointing device 111 calculates the current orientation of the portable mortar 10, independently of the saturated electronic components, and causes a mechanical alignment and orientation mechanism 300 to align the mortar tube 14, without resorting to the use of the optical sight unit 20.

The operation of the digital fire control device 100 will be described in greater detail in connection with FIG. 6. The operation of the automatic calibration and pointing device 111 will be described in connection with FIG. 7. In a preferred embodiment, the operation of the automatic calibration and pointing device 111 is described in co-pending U.S. patent application, titled "Automatic Calibration Of Magnetic Sensors Based On Optical Image Tracking," Ser. No. 14/274,917, which was filed on May 12, 2014, and which is incorporated herein by reference in its entirety. It therefore suffices to state herein that the digital pointing device 100 outputs pointing and orientation data related to the weapon 10. Exemplary output data of the digital pointing device 100 include but are not limited to the azimuth, elevation, and roll of the gun tube 14.

The automatic calibration and pointing device 111 accepts input instructions from the digital fire control device 100, and outputs pointing and orientation data related to the portable mortar 10. Exemplary output data of the automatic calibration and pointing device 111 include, but are not limited to, the azimuth, elevation, and roll of the mortar tube 14. The outputs data control the orientation of the mechanical alignment and orientation mechanism 300.

The mechanical alignment and orientation mechanism 300 can be any known or available mechanism, and as a result, it will not be described herein in greater detail. For example, the mechanical alignment and orientation mechanism 300 shown in FIG. 3A is a dovetail mount.

FIG. 5 is a high-level block diagram showing the main components of the digital fire control device 100, the automatic calibration and pointing device 111, and the mechanical alignment and orientation mechanism 300, that automatically stabilize and realign the portable mortar 10, through and after the firing shock. As a result, it is now possible to replace the conventional optical sight unit 20 of the portable mortar 10 with the digital positioning system 500, as further illustrated in FIG. 3B.

The automatic calibration and pointing device 111 generally comprises inertial and magnetic sensors 510, that include for example, an inertial measurement unit (IMU). The automatic calibration and pointing device 111 further includes a camera 515, a processor (e.g., an image processing unit) and a memory 520, wherein the algorithm used by the automatic calibration and pointing device 111 is stored on the memory and processed by the processor. The automatic calibration and pointing device 111 further includes other components, including but not limited to a magnetometer, a gyroscope, and a chronometer, that are collectively referenced by the numeral 525.

By using the camera 515, the automatic calibration and pointing device 111 is capable of optically tracking the orientation of the mortar tube 14, through and after the firing event, and of further re-aligning the mortar tube 14, as soon as the firing shock has dissipated. The inertial and magnetic sensors track the motion of the mortar tube 14 during and after firing. The camera 515 optically tracks the movement of the mortar tube 14 during the firing event when the inertial and magnetic sensors 510 become saturated and thus unreliable.

The processor 520 uses the input data from the camera 515 to calculate the current orientation of the mortar tube 14, in real time. The magnetometer 525 provides heading alignment to the inertial and magnetic sensors 510 and the camera 515. More specifically, the processor 520 uses input data from the camera 515 and the inertial and magnetic sensors 510, to instruct the other components 525, such as the chronometer, the gyroscope, and the magnetometer, of the current orientation of the mortar tube 14, and if needed, to cause the realignment of the mortar tube 14 to the target orientation.

As an example, the automatic calibration and pointing device 111 can be mounted onto an 81 mm portable mortar 10. During the firing event, the IMU and other sensors 510 might lose alignment; however, the camera 515 continues to track the true orientation of the mortar tube 14. Following the firing event, the processor 520 realigns the IMU and the other sensors 510 to the reference orientation provided optically by the camera 515.

As a result, the automatic calibration and pointing device 111 provides an alternative optical tracking method for determining the current orientation of the mortar tube 14. The digital fire control device 100 provides a visual interface for the gunner. The digital positioning system 500 allows the portable mortar 10 to be realigned to the initial target position, despite the saturation of the electronic sensors 510 and the other components 525. As a result, the automatic calibration and pointing device 111 causes the mechanical alignment and orientation mechanism 300 of the portable mortar 10 to automatically and digitally align the mortar tube 14, shortly (e.g., within seconds) after firing.

In the event of saturation of the electronic components (e.g., 510) following the firing shock, the processor 520 disregards the input data from these saturated components 510. Instead, the automatic calibration and pointing device 111 relies on input optical data obtained from the camera 515. To this end, the camera 515 stores a reference image associated with initial target orientation, and then uses this reference image to determine its current orientation. Based on the mismatch between the target orientation, as reflected in the stored reference image, and the current orientation, the automatic calibration and pointing device 111 realigns the saturated electronic sensors 520 back to the target orientation.

As a result, although the magnetic and inertial sensors 520 may become saturated after firing, the automatic calibration and pointing device 111 is capable of continuously tracking the true orientation of the mortar tube 14, without losing the stored target pointing and orientation data.

Following the firing event, the mechanical alignment and orientation mechanism 300 remains under the control of the digital positioning system 500. To this end, the digital fire control device 100 includes a processor (or CPU) and associated memory 550. A firing control algorithm 560 is stored on the memory and processed by the processor 550, as it will be explained later in greater detail in connection with FIG. 6. A screen 570 provides the gunner with a visual interface between the digital tire control device 100 and the automatic calibration and pointing device 111.

Figure 6:
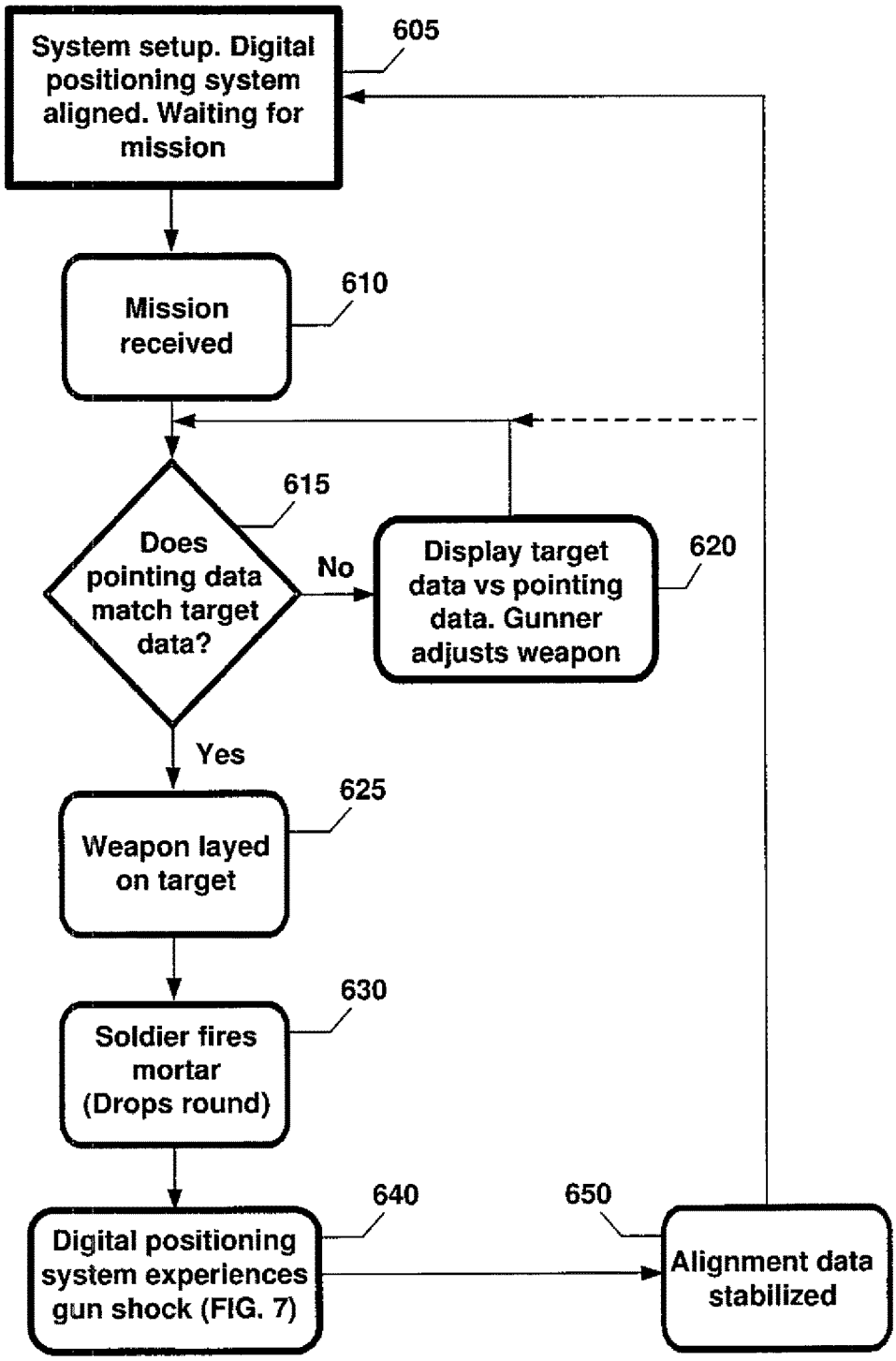
FIG. 6 is a flowchart that illustrates an exemplary operation of the digital fire control device.

FIG. 6 is a flowchart that illustrates an exemplary method 600 for operating the digital fire control device 100. At step 605, the portable mortar 10 is ready for firing, and the automatic calibration and pointing device 111 is aligned, awaiting the start of mission signal from the digital fire control device 100.

At step 610, the gunner receives the instructions to start the firing mission on the digital fire control device 100, and checks, at step 615, whether the current pointing data of the portable mortar 10 correspond to the target data of the mission in question. If the data do not match, the gunner uses the digital fire control device 100 to input the target data into the mechanical alignment and orientation mechanism 300.

In turn, the automatic calibration and pointing device 111 causes the mechanical alignment and orientation mechanism 300 to reorient the mortar tube 14 to the target destination. Once this reorientation step is completed, the gunner re-checks, at step 615, whether the current pointing data of the portable mortar 10 correspond to the target data of the mission in question. The correction loop (steps 615, 620) is repeated until the pointing data match each other.

Thereupon, the portable mortar 10 is layed on target at step 625, and the gunner fires the portable mortar 10, such as by dropping the round in the mortar tube 14, at step 630.

At step 640, and in response to the firing shock, the automatic calibration and pointing device 111 undergoes an optical stabilization routine 700, as it will be described later in connection with FIG. 7, to correct for orientation disparity and to realign the inertial and magnetic sensors 510 using the stored optical orientation.

At step 650, the automatic calibration and pointing device 111 transmits a message to the digital fire control device 100, confirming that the alignment data have been stabilized. The gunner then determines whether to loop back to step 605 and await a new mission, or to step 615 (shown in dotted lines) and continue the mission as instructed.

Figure 7:
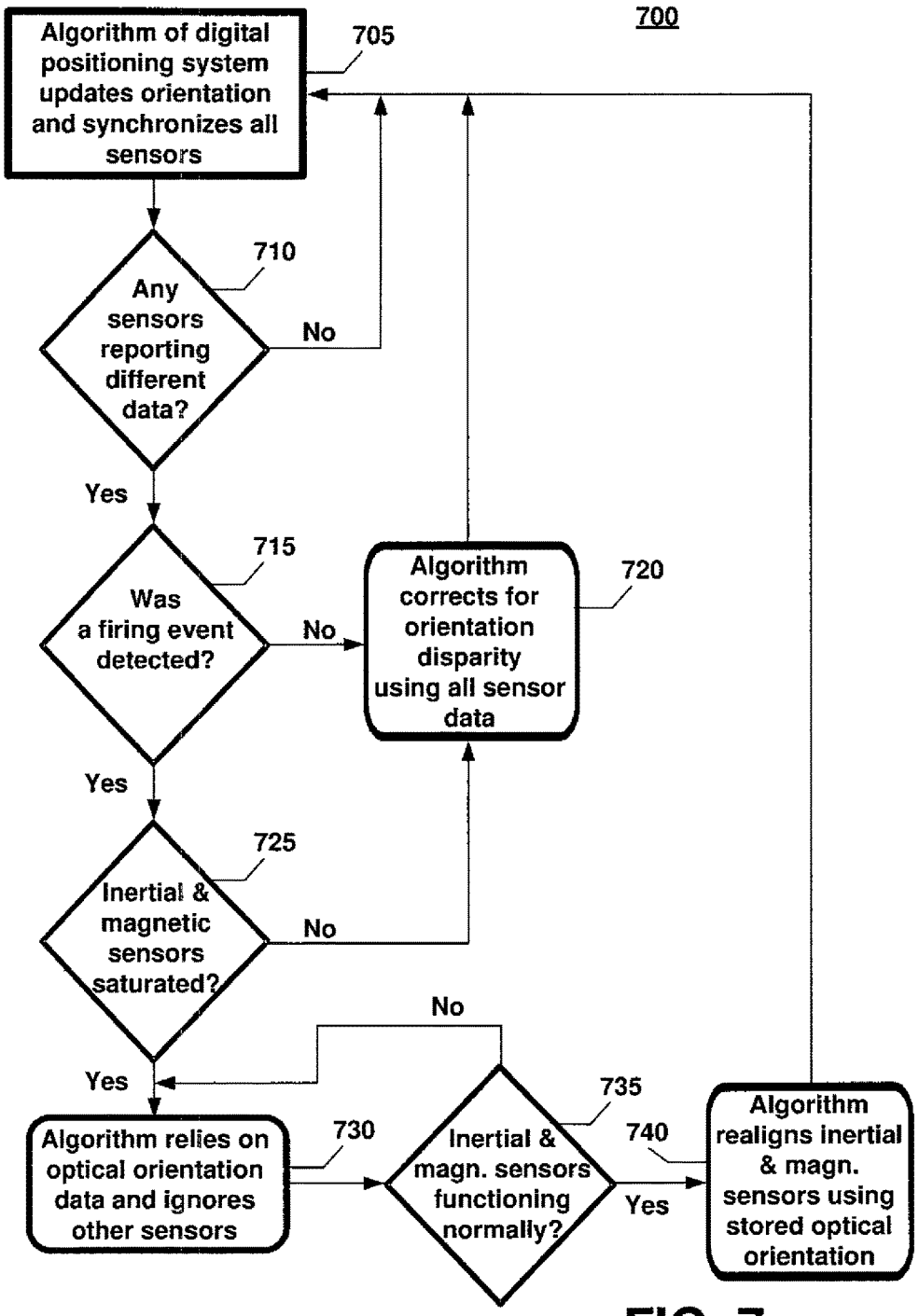
FIG. 7 is a flowchart that illustrates an exemplary operation of the automatic calibration and pointing device.

FIG. 7 is a flowchart that illustrates the method or algorithm) 700 for operating the automatic calibration and pointing device 111. Following the firing step 630 of FIG. 6, the algorithm 700 updates the orientation of the mortar tube 14 and synchronizes all the inertial and magnetic sensors, at step 705. Based on the fact that sensors tend to drift from their original pointing direction and thus lose alignment, the algorithm 700 inquires at step 710 if any one or more of the sensors is reporting incorrect pointing information or loss of alignment. If not, the algorithm 700 loops back to step 705 and the automatic calibration and pointing device 111, re-updates the orientation of the mortar tube 14, and re-synchronizes all the inertial and magnetic sensors.

If, on the other hand, the algorithm 700 determines at step 710 that at least one of the sensors has reported incorrect pointing information or loss of alignment, then the algorithm 700 inquires at step 715 whether a firing event was detected. If it has not, then the algorithm 700 proceeds to step 720 and corrects for orientation disparity using all the sensor data that are in agreement with the reliable sensors data, and loops back to step 705, as described earlier.

If, however, the algorithm 700 determines at step 715 that a firing event was detected, then it proceeds to step 725 and inquires whether the inertial and magnetic sensors became saturated as a result of the firing event. It they have not, then the algorithm 700 proceeds to step 720 and loops back to step 705, as described earlier.

If the algorithm 700 determines at step 725 that the inertial and magnetic sensors have become saturated, it proceeds to step 730 and relies on the optical orientation data, ignoring the data from all the inertial and magnetic sensors.

The algorithm 700 then proceeds to decision step 735 and inquires whether the inertial and magnetic sensors are functioning properly. If they are not, then the algorithm 700 loops back to step 730 as described earlier. If, however, the algorithm determines that the inertial and magnetic sensors are functioning properly, then it proceeds to step 740 and realigns the inertial and magnetic sensors using the stored optical orientation data. The algorithm 700 then loops back to step 705, as described earlier.

Figure 4:
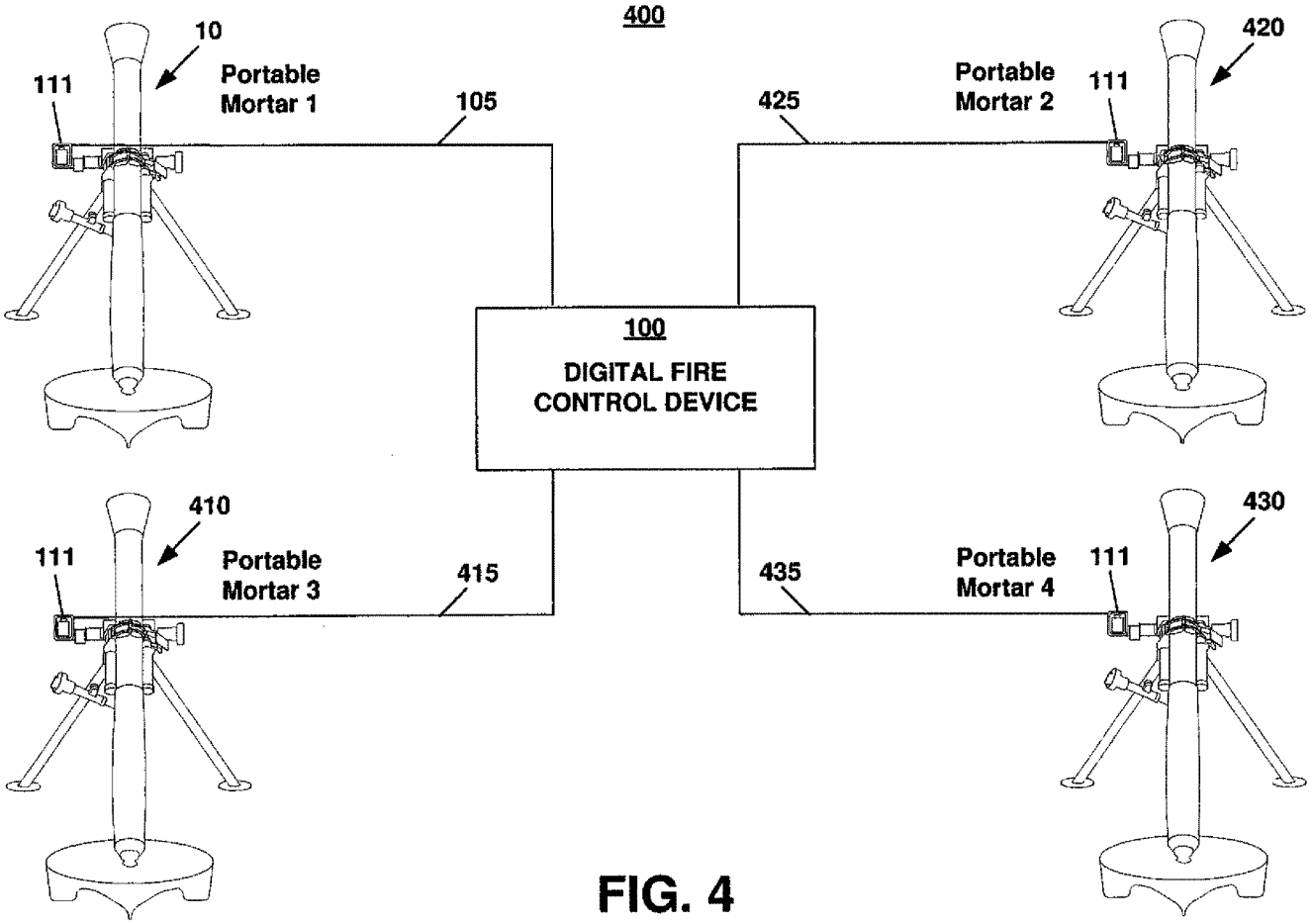
FIG. 4 is a block diagram illustrating a network of weapons of the type shown in FIGS. 1 and 2.

FIG. 4 is a block diagram illustrating a network 400 of portable mortars 10, 410, 420, 430, of the type shown in FIGS. 1 and 2. The portable mortars 10, 410, 420, 430 are in communication with a single digital fire control device 100 under the command of a single gunner (or command center). Communication could be established by means of cables, e.g., 105, 415, 425, 435, or wirelessly. While only four portable mortars 10, 410, 420, 430 are illustrated herein, it should be amply clear that a different number of different or similar portable mortars may be networked with the digital fire control device 100, to operate according to the present invention. It should also be understood that the portable mortars 10, 410, 420, 430 may be dissimilar weapons and/or with different orientations.

It is to be understood that the phraseology and terminology used herein with reference to device, mechanism, system, or element orientation (such as, for example, terms like "front", "back", "up", "down", "top", "bottom", "forward", "rearward", and the like) are only used to simplify the description of the present invention, and do not alone indicate or imply that the mechanism or element referred to must have a particular orientation. In addition, terms such as "first", "second", and "third" are used herein and in the appended claims for purposes of description and are not intended to indicate or imply relative importance or significance.

It is also to be understood that the invention is not limited in its application to the details of construction and the arrangements of components set forth in the following description or illustrated in the drawings. Other modifications may be made to the present design without departing from the spirit and scope of the invention. The present invention is capable of other embodiments and of being practiced or of being carried out in various ways, such as, for example, in military and commercial applications.

What is claimed is:

1. A digital positioning system that interfaces with a portable weapon to automatically realign the portable weapon through and after a firing shock that saturates electronic components of the portable weapon, the digital positioning system comprising:

a digital fire control device that receives target destination data;

wherein the digital fire control device establishes communication with an automatic calibration and pointing device;

wherein the digital fire control device transmits the target destination data to the automatic calibration and pointing device;

wherein the automatic calibration and pointing device:

generates a reference orientation based on the target destination data; and stores the generated reference orientation in memory;

wherein, in response to the firing shock, the automatic calibration and pointing device:

acquires a current orientation of the portable weapon, independently of the saturated electronic components; and outputs data that are based on the stored reference orientation and the acquired current orientation of the portable weapon;

wherein the outputted data cause a mechanical alignment and orientation mechanism to reposition the portable weapon.

2. The digital positioning system of claim 1, wherein the outputted data include: azimuth, elevation, and roll of the portable weapon.

3. The digital positioning system of claim 1, wherein the automatic calibration and pointing device includes at least on inertial sensors that becomes saturated in response to the firing shock.

4. The digital positioning system of claim 3, wherein the automatic calibration and pointing device further includes an optical capture device that:

acquires optical data based on the target destination data; and converts the acquired optical data into a reference image that contains the reference orientation.

5. The digital positioning system of claim 4, wherein the automatic calibration and pointing device further includes an image processor for processing the reference image.

6. A digital positioning method for interfacing with a portable weapon to automatically realign the portable weapon through and after a firing shock that saturates electronic components of the portable weapon, the digital positioning method comprising the steps of:

receiving target destination data at a digital fire control device;

establishing communication with, and transmitting the target destination data to an automatic calibration and pointing device with a digital fire control device;

generating a reference orientation based on the target destination data with the automatic calibration and pointing device;

storing the generated reference orientation in memory at the automatic calibration and pointing device;

acquiring a current orientation of the portable weapon, independently of the saturated electronic components with the automatic calibration and pointing device in response to the firing shock;

outputting data that are based on the stored reference orientation and the acquired current orientation of the portable weapon with the automatic calibration and pointing device in response to the firing shock; and repositioning the portable weapon with the mechanical alignment and orientation mechanism in response to the outputted data.

7. The digital positioning method of claim 6, wherein the outputted data include: azimuth, elevation, and roll of the portable weapon.

8. The digital positioning method of claim 6, wherein the automatic calibration and pointing device includes at least on inertial sensors that becomes saturated in response to the firing shock.

9. The digital positioning method of claim 8 further comprising the steps of:

acquiring optical data based on the target destination data at an optical capture device of the automatic calibration and pointing device; and converting the acquired optical data into a reference image that contains the reference orientation at the optical capture device.

10. The digital positioning method of claim 9 further comprising the step of processing the reference image at an image processor of the automatic calibration and pointing device.

* * * * *